United States Patent [19]

Hosaka

[11] Patent Number: 4,957,088

[45] Date of Patent: Sep. 18, 1990

[54] FUEL INJECTION CONTROL SYSTEM FOR AN AUTOMOTIVE ENGINE

[75] Inventor: Hiroshi Hosaka, Mitaka, Japan

[73] Assignee: Fuji Jukogyo Kabushiki Kaisha, Tokyo, Japan

[21] Appl. No.: 411,552

[22] Filed: Sep. 22, 1989

[30] Foreign Application Priority Data

Oct. 13, 1988 [JP] Japan ..... 63-257645

[51] Int. Cl.[5] ..... F02D 41/34

[52] U.S. Cl. ..... 123/480; 123/488; 123/492; 123/493; 123/494

[58] Field of Search ..... 123/480, 486, 492, 493, 123/494, 478, 488; 364/431.05

[56] References Cited

U.S. PATENT DOCUMENTS

| | | | |
|---|---|---|---|
| 4,750,352 | 6/1988 | Kolhoff | 123/494 |
| 4,884,548 | 12/1989 | Sogawa | 123/492 |
| 4,886,030 | 12/1989 | Oba et al. | 123/492 |
| 4,892,072 | 1/1990 | Miwa et al. | 123/494 |
| 4,899,713 | 2/1990 | Nakamura | 123/486 |

FOREIGN PATENT DOCUMENTS

| | | |
|---|---|---|
| 55-32913 | 3/1980 | Japan . |
| 58-48720 | 3/1983 | Japan . |
| 60-43135 | 3/1985 | Japan . |

*Primary Examiner*—Andrew M. Dolinar
*Attorney, Agent, or Firm*—Martin A. Farber

[57] ABSTRACT

The quantity of air induced in a cylinder of an engine is estimated by using equations based on various coefficients. The coefficients are stored in a memory and derived in accordance with engine operating conditions. The estimated quantity of induced air is corrected so as to approximate quantity of air actually induced in the cylinder. A basic injection pulse width is calculated based on the corrected air quantity. The basic injection pulse width is corrected by a feedback coefficient, thereby producing a fuel injection pulse width signal for operating a fuel injector of the engine.

2 Claims, 5 Drawing Sheets

FUEL INJECTION CONTROL SYSTEM FOR AN AUTOMOTIVE ENGINE

BACKGROUND OF THE INVENTION

The present invention relates to a system for controlling the fuel injection of an automotive engine in dependence on a throttle opening degree and engine speed.

Japanese Patent Application Laid Open No. 55-32913 discloses a fuel injection system wherein a basic fuel injection pulse width Tp is calculated in dependence on throttle opening degree $\alpha$ and engine speed Ne. The basic pulse width Tp are stored in a table and are derived from the table for controlling the fuel injection during the operation of the engine.

However, since there is a space between the throttle valve and a cylinder of the engine, such as a chamber formed downstream of the throttle valve, changing of actual amount of induced air per engine cycle in response to the change of the throttle opening degree during the transient state is delayed. Accordingly, when the throttle valve is rapidly opened, the air-fuel mixture becomes rich To the contrary, when the throttle valve is rapidly closed, the air-fuel ratio becomes lean.

Referring to FIG. 5 showing an increase in quantity of intake air at an acceleration of a vehicle, the basic fuel injection pulse width is determined dependent on air quantity $M_0$ which is calculated based on the opening degree $\alpha$ of a throttle and engine speed detected at a point A before an induction stroke. However, an actual air quantity $M_1$ at a point B after the induction stroke is larger than the quantity $M_0$. Thus, there is a difference $\Delta M$ between the estimated quantity $M_0$ and the actual quantity $M_1$. As a result, the air-fuel ratio fluctuates at a transient state.

Japanese Patent Application Laid Open No. 58-48720 discloses a system wherein the basic fuel injection quantity is corrected in accordance with a reference value when the engine speed exceeds a predetermined speed during acceleration. Although the system prevents the air-fuel mixture from becoming overrich, it does not control the fuel injection quantity in dependency on the actual intake air quantity.

In a system disclosed in Japanese Patent Application Laid Open No. 60-43135, a necessary air flow is estimated dependent on the depressing degree of an accelerator pedal and engine speed. The fuel injection quantity is determined taking account of a first order lag of the actual air flow. Accordingly, fuel is gradually increased until the actual air flow coincides with the necessary air flow. However, the estimation of the air flow is inaccurate so that the air-fuel ratio of the fuel mixture fluctuates.

SUMMARY OF THE INVENTION

The object of the present invention is to provide a system for controlling the fuel injection where air-fuel mixture is prevented from becoming rich or lean during transient states and kept at an optimum air-fuel ratio.

In accordance with the present invention, the quantity of air inducted in a cylinder of an engine is estimated by using equations based on various coefficients. The estimated air quantity is corrected so as to approximate the actual induced air quantity.

A basic injection pulse width is calculated by the corrected induced air quantity.

According to the present invention, there is provided a system for controlling fuel injection of an engine for a motor vehicle comprising an engine speed sensor for producing an engine speed signal dependent on speed of the engine, a throttle position sensor for producing a throttle opening degree signal dependent on opening degree of a throttle valve, an intake air temperature sensor for producing an intake air temperature signal, storing means storing various coefficients which are arranged in accordance with the engine speed signal, the throttle opening degree signal, and the intake air temperature signal, first calculator means for calculating a quantity of induced air, using coefficients derived from the storing means in accordance with the engine speed signal, throttle opening degree signal and intake air temperature signal, correcting means for correcting the induced air quantity calculated by the first calculator means, using a coefficient derived from the storing means in accordance with the engine speed signal, and second calculator means for producing a basic injection pulse width signal in accordance with a corrected induced air quantity corrected by the correcting means.

In an aspect of the invention, the system further comprises third calculator means for calculating a quantity of throttle valve passing air, and fourth calculator means for calculating an intake passage pressure based on the calculated quantity of throttle valve passing air and a coefficient in accordance with the intake air temperature signal, the first calculator means calculates the induced air quantity further based on the calculated intake passage pressure.

The other objects and features of this invention will become understood from the following description with reference to the accompanying drawings.

DETAILED DESCRIPTION OF THE PREFERRED EMBODIMENT

Figures 1, 2:
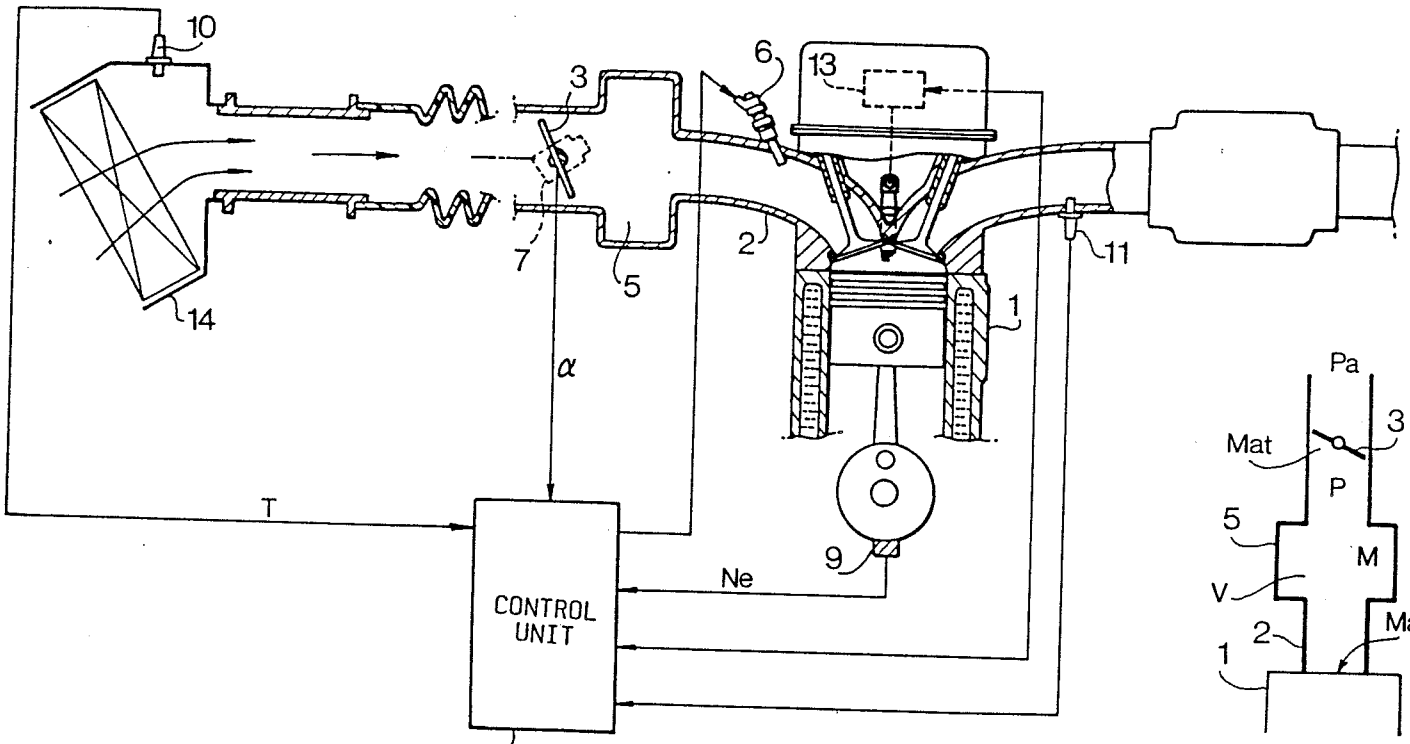
FIG. 1 is a schematic diagram showing a system according to the present invention.
FIG. 2 is a schematic view of an intake system, for explaining various factors.

Referring to FIG. 1, in an intake passage 2 of an engine 1, a throttle chamber 5 is provided downstream of a throttle valve 3 so as to absorb the pulsation of intake air. Multiple point fuel injectors 6 are provided in the intake passage 2 at adjacent positions of intake valve so as to supply fuel to each cylinder of the engine 1. A throttle position sensor 7 is provided on the throttle valve 3. An engine speed sensor 9 is provided on the engine 1. An intake air temperature sensor 10 is provided on an air cleaner 14. An $0_2$-sensor 11 is provided in an exhaust passage. Output signals of the sensors for detecting respective conditions are applied to a control unit 12 comprising a microcomputer to operate the fuel injectors 6 and an ignition coil 13.

The quantity Map of the air induced in the cylinder is estimated based on a model of the intake system as shown in FIG. 2.

In FIG. 2, Pa designates the atmospheric pressure, $\rho a$ is the density of the atmosphere, Map is the quantity of the air induced in the cylinder of the engine 1, Mat is the quantity of the air passing the throttle valve 3, P is the pressure in the intake passage 2, V is the capacity of the intake passage, and M is the quantity of the air in the intake passage.

The quantity of accumulated air is represented as $$dM/dt = Mat - Map \quad (1)$$

The equation of state is $$PV = MRT \quad (2)$$

The quantity of the air induced in the cylinder Map is $$Map = (Ne \cdot D/2RT) \cdot \eta v \cdot p \quad (3)$$

The quantity of the air passing the throttle valve Mat is $$Mat = C \cdot A \cdot \psi \cdot \sqrt{Pa \cdot \rho a} \quad (4)$$

In this case, when $P/Pa > \{2/(k+1)\}^{k/(k-1)}$, $$\psi = \sqrt{2gk/(k-1)\,[(P/Pa)^{2/k} - (P/Pa)^{(k+1)/k}]}$$

and when $P/Pa < \{2/(k+1)\}^{k/(k-1)}$, $$\psi = \sqrt{2gk/(k+1)\ \{2/(k+1)\}^{2/(k-1)}}.$$

In the equations, $\alpha$ is the throttle valve opening degree, Ne is the engine speed, D is the displacement, $\eta v$ is the volumetric efficiency, C is the coefficient for the quantity of air passing the throttle valve, R is the gas constant, K is the specific heat ratio, g is the gravitational acceleration, T is the intake air temperature, and A is the air passage sectional area.

From the above equations, $$dP/dt = (RT/V) \cdot Mat - (D/2V) \cdot Ne \cdot \eta v \cdot p \quad (5)$$

Discreting this equation, $$P(k+1) = (RT/V) \cdot \Delta t \cdot Mat(k) + \{(1 - D/2V) \cdot Ne \cdot \eta v \Delta t\} \cdot p(k) \quad (6)$$

(where $\Delta t$ is a sampling cycle)

Thus, the intake air quantity Map is obtained by substituting the intake passage pressure P obtained by the equation (6) for the equation (3).

The air quantity Map is an estimation calculated before an induction stroke based on the signals from various sensors. In particular, during a transient state, the throttle valve opening degree and the engine speed vary even in the induction stroke. Consequently, the estimated quantity Map differs from the quantity of actually induced air. Accordingly, it is necessary to correct air quantity Map. The corrected quantity Map is calculated as follows.

$$Map^*(k) = Map(k) + Ka\{Map(K) - Map(k-1)\} \quad (7)$$

where Ka is a coefficient relative to the engine speed. Thus, the induced air quantity is corrected in dependency on the difference between the induced air quantity Map(k−1) obtained at the last calculation and the air quantity Map(k) obtained at the present calcalation.

A basic fuel injection pulse width Tp is calculated based on the corrected air quantity Map*(k).

Figure 3:
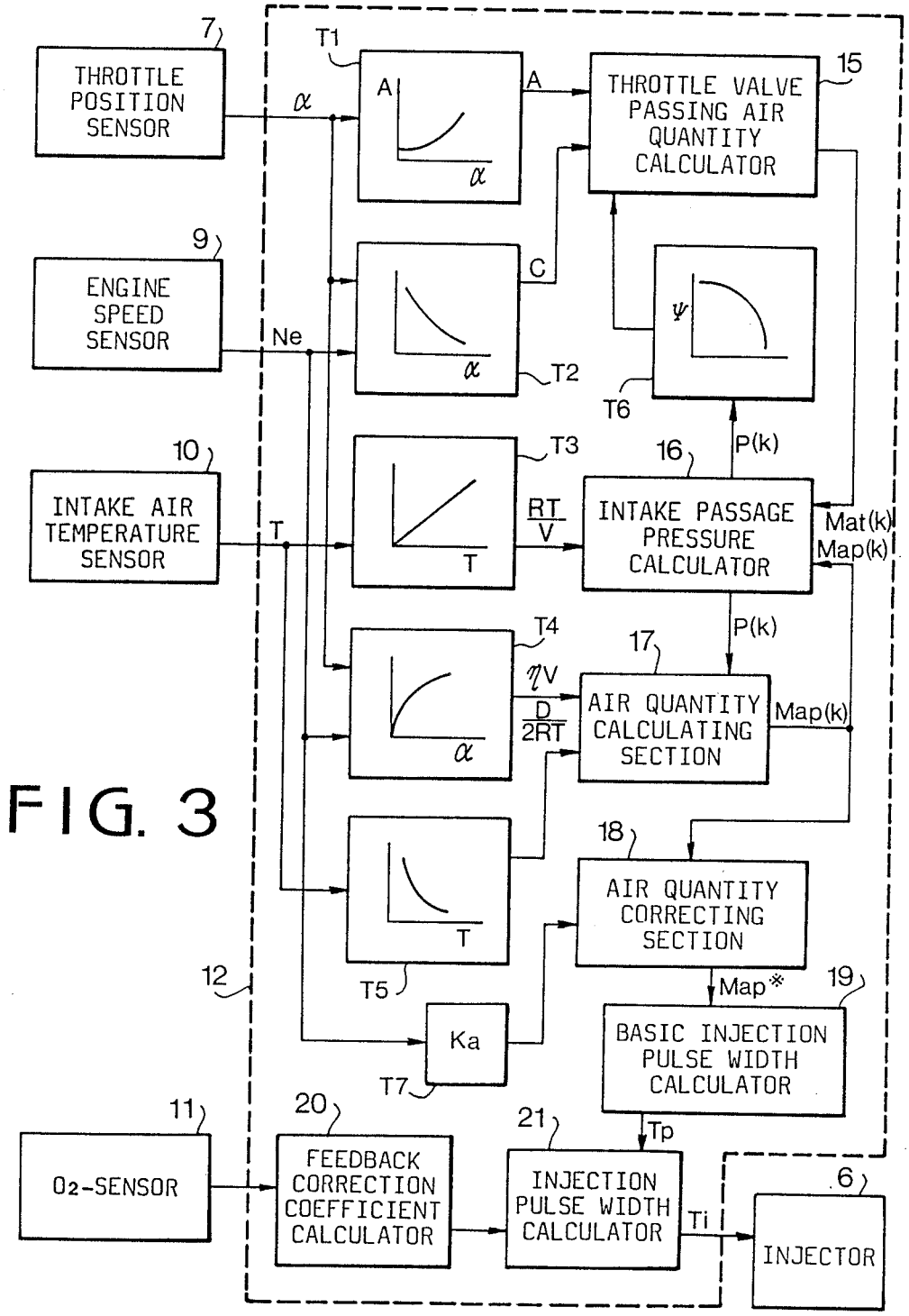
FIG. 3 is a block diagram showing a control unit of the present invention.

Referring to FIG. 3, the control unit 12 comprises a ROM which has tables $T_1$ to $T_6$ storing respective coefficients for the discreted model equations. Each coefficient is derived in accordance with engine operating conditions detected by respective sensors, namely, the engine speed Ne, throttle opening degree $\alpha$ and intake air temperature T. The air passage sectional area A is derived from table $T_1$ in accordance with the throttle valve opening degree $\alpha$. In accordance with the throttle opening degree $\alpha$ and the engine speed Ne, the coefficient C is derived from table $T_2$ and the coefficient $\eta v$ is derived from table $T_4$ in accordance with throttle opening degree $\alpha$ and engine speed Ne. In accordance with the intake air temperature T, the coefficient RT/V is derived from table $T_3$ and the coefficient D/2RT is derived from table $T_5$. These coefficients are used as operators of the model equations at that time.

An intake passage pressure calculator 16 and a throttle valve passing air quantity calculator 15 are provided. The intake passage pressure calculator 16 is applied with coefficient RT/V and the throttle valve passing air quantity Mat(k) and the air quantity Map(k) and the intake passage P(k+1) is calculated by the following equation.

$$P(k+1) = P(k) + RT/V\{Mat(k) - Map(k)\}$$

The value P(k) is applied to table $T_6$ to derive the coefficient $\Psi$ which is applied to the throttle valve passing air quantity calculator 15. The calculator 15 is applied with coefficients A and C, and calcualtes the air quantity Mat(k). The intake passage pressure P(k) and the coefficients $\eta v$ and D/2RT are applied to an air quantity caluclating section 17 where the quantity of the air Map induced in the cylinder is calculated. An air quantity correction section 18 is provided for correcting the calculated air quantity Map. The air quantity correcting section 18 makes a calculation of the equation (7) using the coefficient Ka derived from a table $T_7$ in accordance with the engine speed Ne. The corrected quantity Map* is fed to a basic fuel injection pulse width calculator 19 for calculating a basic injection pulse width Tp.

The control unit 12 further has a feedback correction coefficient calculator 20 for calculating a feedback correction coefficient $K_{FB}$ based on an output voltage of the $0_2$ sensor 11, and has a fuel injection pulse width calculator 21 which is applied with the basic injection pulse width Tp and the correction coefficient $K_{FB}$ for correcting basic injection pulse width Tp in accordance with the coefficient $K_{FB}$ and calculates a fuel injection pulse width Ti.

In the basic fuel injection pulse width calculator 19, the basic fuel injection pulse width Tp is calculated in accordance with $$Tp = Map^*(k)/A/F$$

where A/F is a desired air fuel ratio. In the feedback correction coefficient calculator 20, the feedback correction coefficient $K_{FB}$ calculated in dependency on the output voltage of the $O_2$ sensor 11. The basic fuel injection pulse width Tp and the feedback correction coefficient $K_{FB}$ are applied to the injection pulse width calculator 21 where the injection pulse width Ti is calculated by the following equation.

$$Ti = Tp \cdot K_{FB}$$

The pulse width Ti is applied to the injectors 6 for injecting the fuel.

Figure 6:
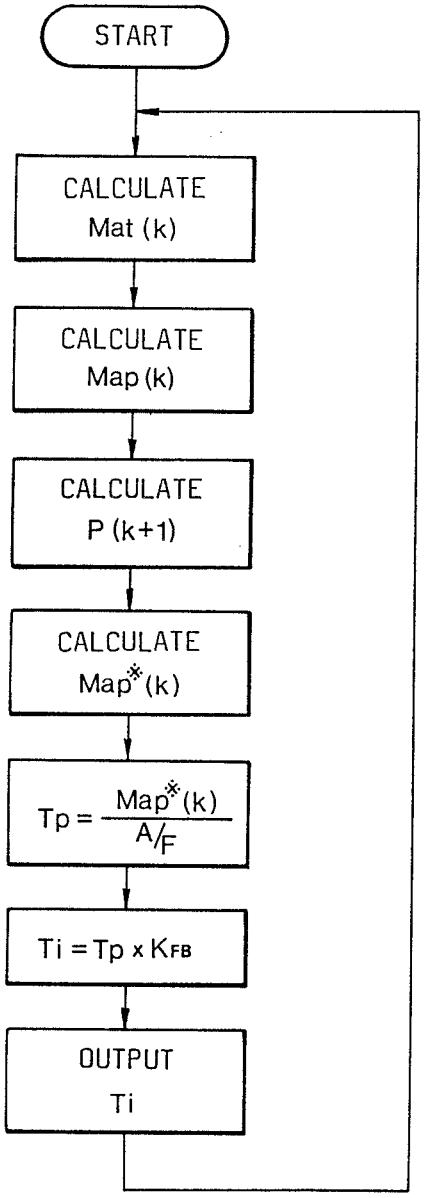
FIG. 6 is a flowchart explaining the operation of the system of the present invention.

The fuel injection pulse width Ti is calculated as shown in the flowchart of FIG. 6.

The operation of the present invention is explained hereinafter with reference to FIGS. 4*a* to 4*c*.

Figure 4A:
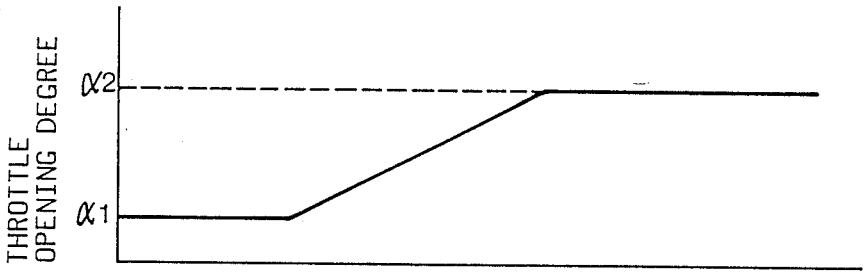
FIGS. 4*a* to 4*c* are graphs showing changes of throttle opening degree, induced air quantity and excessive air quantity, respectively.
Figure 4B:
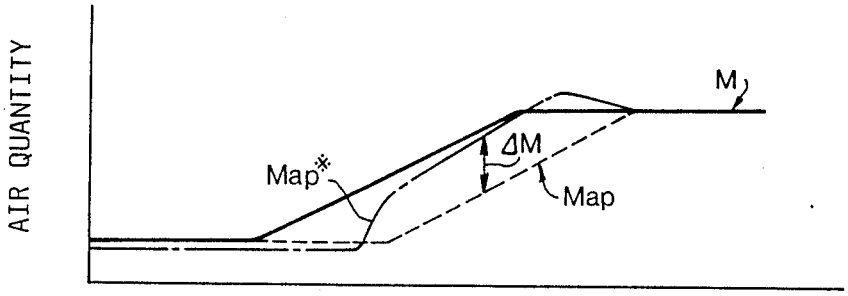
Figure 4C:
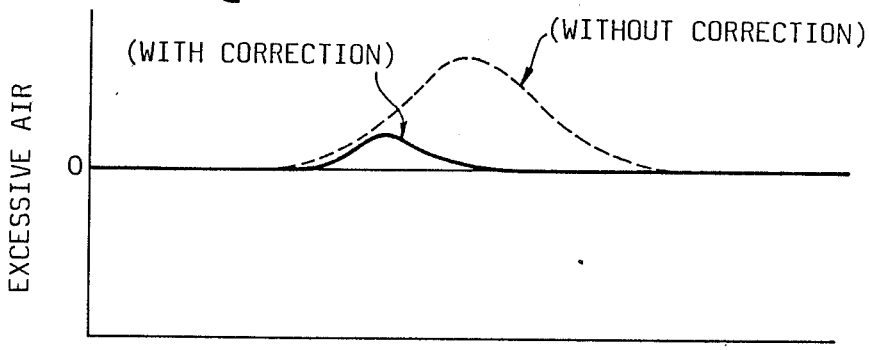
Figure 5:
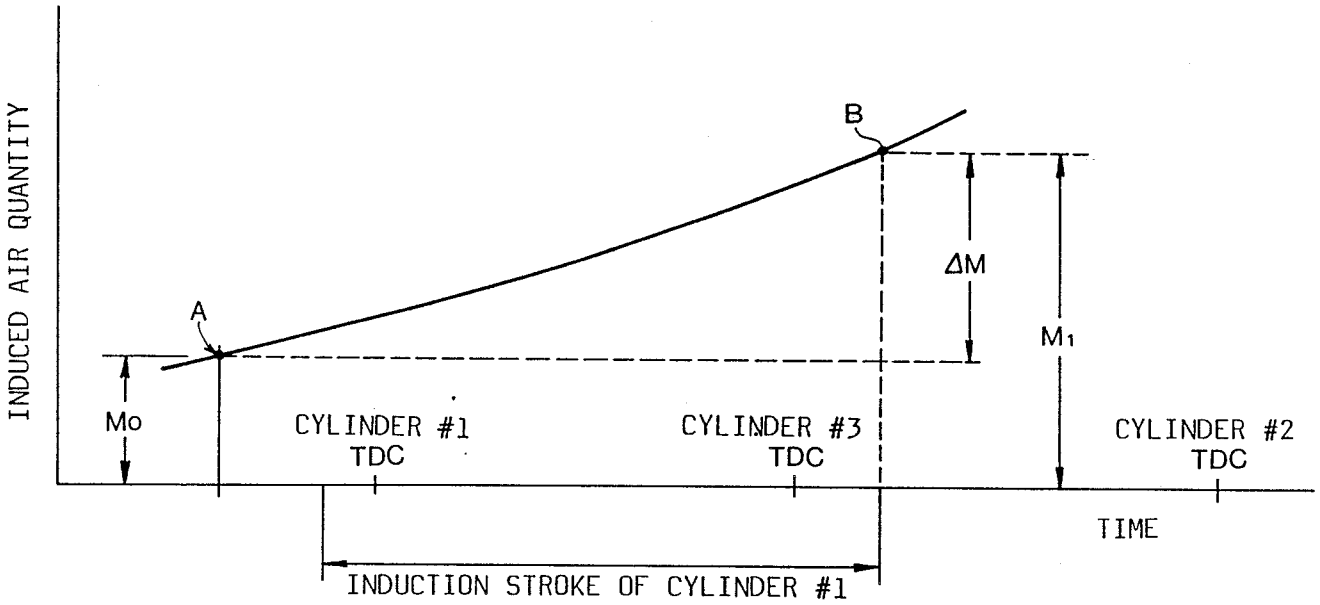
FIG. 5 is a graph showing characteristics of the induced air quantity.

In a transient state, the throttle valve opening degree increases from to $\alpha_1$ to $\alpha_2$ shown in FIG. 4*a*, the actual induced air quantity M shown by a solid line in FIG. 4*b* increases accordingly. The estimated air quantity Map shown by a dotted line increases with a delay so that there is a difference ΔM between the actual air quantity M and the estimated air quantity Map The estimated air quantity Map is corrected to the air quantity Map* shown by a dot-dash line, which increases approximately with the actual air quantity M. Thus, the air quantity Map is corrected to a value corresponding to the opening degree of the throttle valve 3.

Therefore, an optimum quantity of fuel based on the air quantity Map*(k) is injected through the injectors 6. As a result, excess of air over the quantity of fuel slightly exists only at the start of the acceleration as shown in FIG. 4*c*, so that the air-fuel ratio is prevented from becoming excessively lean. Similarly, the air-fuel ratio is kept from becoming over-rich when the vehicle is decelerated.

In accordance with the present invention, the quantity of the air estimated by the model equations is corrected to approximate the actual quantity of induced air. Accordingly, an optimum air-fuel ratio is provided for preventing air-fuel mixture from becoming rich or lean at a transient state, thereby improving driveability of the automobile.

While the presently preferred embodiment of the present invention has been shown and described, it is to be understood that this disclosure is for the purpose of illustration and that various changes and modifications may be made without departing from scope of the invention as set forth in the appended claims.

What is claimed is:

1. A system for controlling fuel injection of an engine for a motor vehicle having an intake passage, a throttle valve provided in the intake passage, and a fuel injector, the system comprising:

an engine speed sensor for producing an engine speed signal dependent on speed of the engine;

a throttle position sensor for producing a throttle opening degree signal dependent on opening degree of the throttle valve;

an intake air temperature sensor for producing an intake air temperature signal;

storing means for storing various coefficients which are arranged in accordance with the engine speed signal, the throttle opening degree signal and the intake air temperature signal;

first calculator means for calculating a quantity of induced air, using coefficients derived from the storing means in accordance with the engine speed signal, throttle opening degree signal and intake air temperature signal;

correcting means for correcting the induced air quantity calculated by the first calculator means, using a coefficient derived from the storing means in accordance with the engine speed signal and for producing a corrected induced air quantity signal; and second calculator means for producing a basic injection pulse width signal in accordance with said corrected induced air quantity signal so as to approximate to an actual induced air quantity.

2. The system according to claim 1 further comprising third calculator means for calculating a quantity of throttle valve passing air, and fourth calculator means for calculating an intake passage pressure based on the calculated quantity of throttle valve passing air and a coefficient in accordance with the intake air temperature signal, the first calculator means calculates the induced air quantity further based on the calculated intake passage pressure.

* * * * *